US012110893B2

(12) United States Patent
Zhang et al.

(10) Patent No.: US 12,110,893 B2
(45) Date of Patent: Oct. 8, 2024

(54) MAIN BEARING SEAT FOR SCROLL COMPRESSOR, AND SCROLL COMPRESSOR

(71) Applicant: Copeland Climate Technologies (Suzhou) Co. Ltd., Jiangsu (CN)

(72) Inventors: Yue Zhang, Suzhou (CN); Ji Liang, Suzhou (CN); Hua Xu, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 270 days.

(21) Appl. No.: 17/606,273

(22) PCT Filed: Nov. 29, 2019

(86) PCT No.: PCT/CN2019/121968
§ 371 (c)(1),
(2) Date: Oct. 25, 2021

(87) PCT Pub. No.: WO2020/215724
PCT Pub. Date: Oct. 29, 2020

(65) Prior Publication Data

US 2022/0316478 A1 Oct. 6, 2022

(30) Foreign Application Priority Data

Apr. 25, 2019 (CN) ..... 201910339565.5
Apr. 25, 2019 (CN) ..... 201920576921.0

(51) Int. Cl.
*F04C 29/02* (2006.01)
*F01C 17/06* (2006.01)
*F04C 18/02* (2006.01)

(52) U.S. Cl.
CPC ..... *F04C 29/02* (2013.01); *F01C 17/066* (2013.01); *F04C 18/0215* (2013.01); *F04C 2240/50* (2013.01)

(58) Field of Classification Search
CPC ..... F04C 29/02; F04C 19/0215; F04C 18/02; F04C 2240/50; F01C 17/066
See application file for complete search history.

(56) References Cited

U.S. PATENT DOCUMENTS 4,340,339 A * 7/1982 Hiraga ..... F04C 29/02 418/55.6
2006/0093506 A1 5/2006 Kim
2013/0177465 A1* 7/2013 Clendenin ..... F04C 18/0215 384/420

FOREIGN PATENT DOCUMENTS

CN 1769708 A 5/2006
CN 202273864 U 6/2012
(Continued)

OTHER PUBLICATIONS

International Search Report (English and Chinese) and Written Opinion (Chinese) of the International Searching Authority issued in PCT/CN2019/121968, mailed on Mar. 4, 2020; ISA/CN.
(Continued)

*Primary Examiner* — Deming Wan
(74) *Attorney, Agent, or Firm* — Harness, Dickey & Pierce, P.L.C.

(57) ABSTRACT

Disclosed are a main bearing seat for a scroll compressor, and a scroll compressor. The main bearing seat comprises substantially ring-shaped thrust parts for supporting a compressing mechanism of the scroll compressor, and a main part body provided with a bearing to support a driving shaft of the scroll compressor, wherein multiple suspension parts extending in a radial direction of the scroll compressor are provided in the thrust parts, and the suspension parts are arranged in an axial direction of the scroll compressor. The main bearing seat can adjust the stiffness of the thrust parts to better achieve stiffness matching and deformation coordination with a bottom face of a movable vortex, thereby
(Continued)

increasing the effective contact area on a contact side of a thrust surface to achieve more uniform contact stress distribution and reduce the wear, and providing an appropriate gap on a non-contact side to facilitate lubrication.

12 Claims, 7 Drawing Sheets

(56) References Cited

FOREIGN PATENT DOCUMENTS

| | | | |
|---|---|---|---|
| CN | 103075341 | A | 5/2013 |
| CN | 202971187 | U | 6/2013 |
| CN | 103195714 | A | 7/2013 |
| CN | 103867444 | A | 6/2014 |
| JP | H04166687 | A | 6/1992 |
| JP | 2011021511 | A | 2/2011 |

OTHER PUBLICATIONS

Office Action regarding Chiense Patent Application No. 2019103395655, dated Dec. 19, 2023, with translation.

* cited by examiner

MAIN BEARING SEAT FOR SCROLL COMPRESSOR, AND SCROLL COMPRESSOR

The present application is the national phase of international Application No. PCT/CN2019/121968 titled "MAIN BEARING SEAT FOR SCROLL COMPRESSOR AND SCROLL COMPRESSOR" and filed on Nov. 29, 2019, which claims priority to Chinese Patent Application No. 201910339565.5, titled "MAIN BEARING SEAT FOR SCROLL COMPRESSOR, AND SCROLL COMPRESSOR", filed with the China National Intellectual Property Administration on Apr. 25, 2019 and claims priority to Chinese Patent Application No. 201920576921.0, titled "MAIN BEARING SEAT FOR SCROLL COMPRESSOR, AND SCROLL COMPRESSOR", filed with the China National Intellectual Property Administration on Apr. 25, 2019. All of the above applications are incorporated herein by reference.

TECHNICAL FIELD

The disclosure relates to a main bearing seat for scroll compressor, and a scroll compressor including the main bearing seat.

BACKGROUND

The contents of this section only provide background information related to the disclosure, which may not constitute the prior art.

A scroll compressor usually includes a compression mechanism composed of a fixed scroll component and an orbiting scroll component to achieve fluid compression. The orbiting scroll component is supported by the main bearing seat or thrust plate to provide axial restraint. The existing thrust design of the orbiting scroll component and the main bearing seat or thrust plate is particularly easy to cause the wear of the main bearing seat or thrust plate and the orbiting scroll component under the heavy load conditions of the scroll compressor. For example, in the operating condition "60/150/20/15-60 Hz" (where 60 is the evaporation temperature, 150 is the condensation temperature, 20 is the superheat degree, 15 is the subcooling degree, and the unit of all temperatures is Fahrenheit; 60 Hz is the operating frequency)". In addition, commonly used refrigerants for scroll compressors include carbon dioxide, R410, and so on. In case that a special refrigerant such as R32 is used, the temperature of the thrust surface may reach, for example, 160 degrees Fahrenheit or even higher, which is much higher than the temperature of commonly used refrigerants. Therefore, the lubrication between the orbiting scroll component and the thrust surface of the thrust plate is deteriorated, resulting in serious wear on the thrust surfaces of the orbiting scroll component and the thrust plate.

Therefore, it is desirable to propose a thrust structure that may reduce wear and improve lubrication for compressors under various conditions, especially when different refrigerants are used.

SUMMARY OF INVENTION

An object of one or more embodiments of the disclosure is to provide a main bearing seat which may adjust the overall rigidity of the thrust portion to better achieve the rigidity matching and deformation coordination with the bottom surface of the orbiting scroll.

A main bearing seat for a scroll compressor is provided according to one or several embodiments of the disclosure. The main bearing seat includes a thrust portion having a substantially annular shape for supporting the compression mechanism of the scroll compressor and a main body portion provided with a bearing to support the drive shaft of the scroll compressor, multiple suspension portions extending in a radial direction of the scroll compressor are provided in the thrust portion, and the suspension portion is arranged along an axial direction of the scroll compressor.

Preferably, one or more grooves are provided in a radially inner portion and/or a radially outer portion of the thrust portion, thereby forming the suspension portion.

Preferably, when viewed in the axial direction, the suspension portions partially overlap each other.

Preferably, each of the suspension portions has opposite rigid end and flexible end on both sides in the radial direction. In the suspension portions, the positions of the rigid end and the flexible end of the first suspension portion in at least one pair of adjacent suspension portions are opposite to the positions of the rigid end and the flexible end of the second suspension portion.

Preferably, the groove includes an outer groove provided in a radially outer portion of the thrust portion, and thus the suspension portion includes an upper suspension portion and a lower suspension portion, a radially outer end of the lower suspension portion is fixed to the main body portion, thereby the flexible end of the upper suspension portion is located on the radially outer side and the rigid end of the upper suspension portion is located on the radially inner side. In addition, the flexible end of the lower suspension portion is located on the radially inner side and the rigid end of the lower suspension portion is located on the radially outer side.

Preferably, the groove further includes a middle additional groove provided in a radially inner portion of the lower suspension portion, and thus the lower suspension portion includes a first lower suspension portion located in the middle and a second lower suspension portion located, on the lower side.

Preferably, the groove further includes a lower additional groove opened downward provided in the radially inner portion of the lower suspension portion, and thus the lower suspension portion includes an inner suspension portion located on the radially inner side and an outer suspension portion located on the radially outer side.

Preferably, the groove includes an upper inner groove provided in the radially inner portion of the thrust portion and a lower outer groove provided in the radially outer portion of the thrust portion, and thus the suspension portion includes the upper suspension portion, the middle suspension portion and the lower suspension portion, and a radially outer end of the lower suspension portion is fixed to the main body portion. The flexible end of the upper suspension portion is located on the radially inner side and the rigid end of the upper suspension portion is located on the radially outer side. The flexible end of the middle suspension portion is located on the radially outer side and the rigid end of the middle suspension portion is located on the radially inner side. In addition, the flexible end of the lower suspension portion is located on the radially inner side and the rigid end of the lower suspension portion is located on the radially outer side.

Preferably, the thrust portion and the main body portion are integrally formed.

Preferably, the groove includes an upper outer groove provided in the radially outer portion of the thrust portion and a lower inner groove provided in the radially inner portion of the thrust portion. The suspension portion includes an upper suspension portion and a lower suspension portion, the flexible end of the upper suspension portion is located on the radially outer side and the rigid end of the upper suspension portion is located on the radially inner side. In addition, the flexible end of the lower suspension portion is located on the radially inner side and the rigid end of the lower suspension portion is located on the radially outer side.

Preferably, the groove is configured to be rectangular, U-shaped, V-shaped or a trapezoid with a narrow bottom and a wide opening in a cross section along the axial direction.

Preferably, an upper wall of the groove closest to the thrust surface of the thrust portion is provided with a stepped portion or a recessed portion.

A scroll compressor is further provided according to the disclosure, which includes the above main bearing seat.

Preferably, the compression mechanism includes an orbiting scroll having an orbiting scroll end plate, the thrust portion is provided with a thrust surface that axially supports the orbiting scroll end plate, thereby axially supporting the orbiting of the orbiting scroll.

According to the main bearing seat of the disclosure, by virtue of the structure of multiple suspension portions arranged in the axial direction of the thrust portion, and in particular, by virtue of the structure that the upper and lower suspension portions have opposite rigid ends and flexible ends located on the radially inner side and the radially outer side, and the positions of the rigid ends and flexible ends of adjacent suspension portions are opposite, the overall rigidity of the thrust portion is adjusted to better achieve the rigidity matching and deformation coordination with the bottom surface of the orbiting scroll. Therefore, for example, the effective contact area is increased at the contact side of the thrust surface to obtain more uniform contact stress distribution to reduce wear, and without affecting the original oil supply structure, a suitable gap is provided on the non-contact side of the thrust surface for the circulation of lubricating oil to facilitate the lubrication of the thrust surface. In addition, the groove forming the suspending portion not only facilitates the cooling of the thrust portion itself, but also allows refrigerant to enter and further promote cooling of the thrust surface.

BRIEF DESCRIPTION OF THE DRAWINGS

The features and advantages of one or more embodiments of the disclosure will become more readily understood from the following description with reference to the accompanying drawings in which.

DETAILED DESCRIPTION OF THE EMBODIMENTS

The following description of the preferred embodiments is only exemplary, and is by no means a limitation to the disclosure and its application or usage. In the description of the present application, the use of directional terms such as "upper" and "lower" is for convenience only and is not intended to be limiting. For example, the upper suspension portion in the case of a vertical scroll compressor may correspond to the left or right suspension portion in the case of a horizontal compressor.

Figure 1:
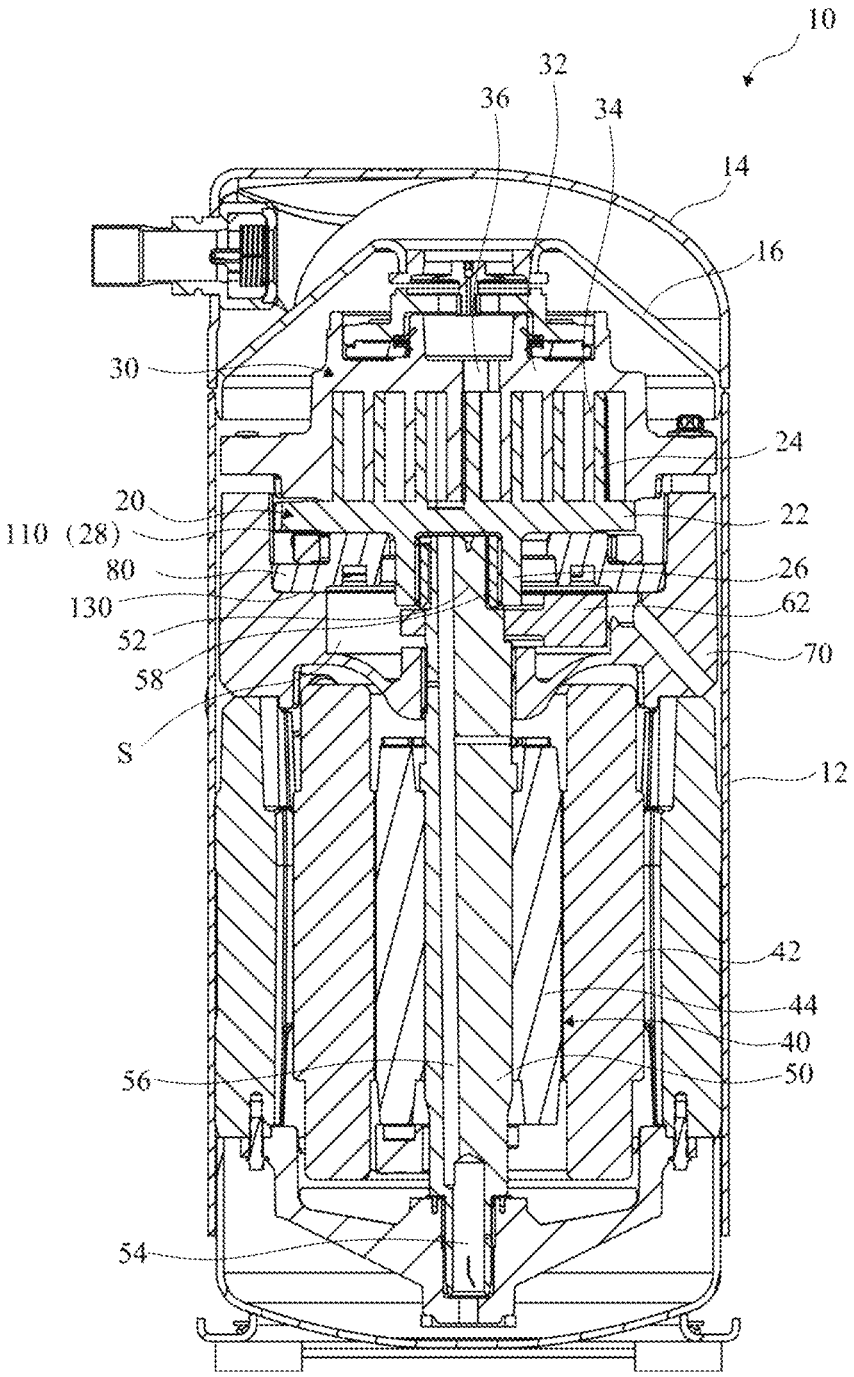
FIG. 1 is a perspective sectional view of a scroll compressor including a thrust plate and a main bearing seat in the conventional technology.

The basic configuration of the scroll compressor is described with reference to FIG. 1.

The scroll compressor (hereinafter referred to as "compressor") 10 includes a generally cylindrical housing 12. An air inlet connector (not shown) is provided on the housing 12 for sucking in low-pressure gaseous refrigerant. An end cover 14 is fixedly connected to one end of the housing 12. The end cover 14 is equipped with a discharge connector for discharging the compressed refrigerant. A partition plate 16 extending transversely with respect to the housing 12 is further provided, between the housing 12 and the end cover 14, so as to divide the internal space of the compressor into a high-pressure side and a low-pressure side. A space between the end cover 14 and the partition plate 16 constitutes a high-pressure side space, and a space between the partition plate 16 and the housing 12 constitutes a low-pressure side space.

The housing 12 contains an orbiting scroll component 20 and a fixed scroll component 30 as a compression mechanism, and a motor 40 and a drive shall 50 as a driving mechanism. The compression mechanism is driven by the driving mechanism and supported by the main bearing seat 70. The main bearing seat 70 may be fixed to the housing 12 in any desired manner, such as riveting at multiple points.

The orbiting scroll component 20 includes an end plate 22, a scroll 24 provided on one surface (upper surface in FIG. 3) of the end plate 22, and a cylindrical hub portion 26 provided on the other surface (lower surface in in FIG. 3) of the end plate 22. The fixed scroll component 30 includes an end plate 32 and a scroll 34. The scroll 24 of the orbiting scroll component 20 meshes with the scroll 34 of the fixed scroll component 30, and in case that the orbiting scroll component 20 and the fixed scroll component 30 move relative to each other, a fluid chamber whose volume gradually decreases from the outside to the center is formed therebetween, thereby compressing the refrigerant in the fluid chamber.

The motor 40 includes a stator 42 and a rotor 44. The stator 42 is fixedly connected to the housing 12. The rotor 44 is fixedly connected to the drive shaft 50 and rotates in the stator 42.

The first end (upper end in FIG. 1) of the drive shaft 50 is provided with an eccentric crank pin 52 and a counterweight 62. The counterweight 62 is fixedly arranged on the drive shaft 50, and therefore rotates integrally with the drive shaft 50 during the rotation of the drive shaft 50. The upper part of the drive shaft 50 is rotatably supported by a bearing in the main bearing seat 70. The counterweight 62 is located in the main bearing seat 70. The second end (the lower end in FIG. 1) of the drive shaft 50 may include a concentric hole 54. The concentric hole 54 leads to the eccentric crank pin 52 at the first end of the drive shaft 50 via the eccentric hole 56.

The eccentric crank pin 52 of the drive shaft 50 is inserted into the hub portion 26 of the orbiting scroll component 20 via a bush 58 to rotationally drive the orbiting scroll component 20. In a case that the orbiting scroll component 20 moves relative to the fixed scroll component 30, the fluid chamber between the orbiting scroll component 20 and the fixed scroll component 30 moves from the radially outer position to the center position of the orbiting scroll component 20 and the fixed scroll component 30 and is compressed. The compressed fluid is discharged through the exhaust port 36 provided in the center of the end plate 32 of the fixed scroll component 30.

In order to prevent the orbiting scroll component 20 from moving in the axial direction, a thrust plate 80 is provided between the orbiting scroll component 20 and the main bearing seat 70. The counterweight 62 may be provided between the thrust plate 80 and the main bearing seat 70. The thrust plate 80 may be fixed on the main bearing seat 70. The thrust plate 80 has a thrust surface 110 as a first surface and a second surface 130 opposite to the first surface, where the thrust surface 110 of the thrust plate 80 is in contact with the thrust surface 28 of the end plate 22 of the orbiting scroll component 20, thereby preventing the orbiting scroll component 20 from moving in the axial direction. The thrust surfaces 28, 110 are substantially flat surfaces. During the rotation of the drive shaft 50, relative movement occurs between the thrust surface 28 of the end plate 22 of the orbiting scroll component 20 and the thrust surface 110 of the thrust plate 80. Since the radially inner side is not fixed to the main bearing seat 70, the thrust plate 80 may collapse at the radially inner side under the axial load of, for example, a compression mechanism, thereby reducing the effective contact area between the thrust surface 110 of the thrust plate 80 and the thrust surface 28 of the end plate 22 at the radially inner position, and causing uneven stress distribution and local stress concentration on the thrust surface 110, thus increasing the wear of the thrust surface.

The end of the concentric hole 54 is immersed in the lubricating oil at the bottom of the compressor housing or otherwise supplied with lubricating oil. During the operation of the compressor, one end of the concentric hole 54 is supplied with lubricating oil by the lubricating oil supply device, the lubricating oil entering the concentric hole 54 is pumped or thrown into the eccentric hole 56 by the centrifugal force during the rotation of the drive shaft 50 and flows upward along the eccentric hole 56 until it reaches the end of the eccentric crank pin 52. The lubricating oil then enters the space S between the main bearing seat 70 and the thrust plate 80 via the gap between the eccentric crank pin 52, the bush 58 and the hub portion 26 of the orbiting scroll component 20 and accumulates in the space S. As described above, the counterweight 62 is fixedly disposed at one end of the drive shaft 50 and is located between the thrust plate 80 and the main bearing seat 70, that is, in the space S. As the drive shaft 50 rotates, the counterweight 62 fixedly arranged at one end of the drive shaft also rotates, lubricating oil collected in the space S, especially at the bottom of the space S, is stirred by the counterweight 62 and splashed onto the thrust surface under the action of centrifugal force for lubrication. However, during the orbiting process of the orbiting scroll component, the contact side and the non-contact side are alternately formed on the thrust surface 110 of the thrust plate 80. On the non-contact side, the gap between the two thrust surfaces is often too small, so that sufficient circulation channels are not provided for the lubricating oil, which is not conducive to the lubrication of the thrust surfaces.

In addition, under the heavy load condition of the compressor, especially when special refrigerants such as R32 are used, the temperature of the thrust surface becomes very high (for example, 160 degrees Fahrenheit or even higher), which is much higher than the temperature when common refrigerants are used, and the structure of the thrust plate is both wide and thick, which is not conducive to the cooling of the thrust plate itself, and also reduces the cooling effect of the refrigerant on the thrust surface. Therefore, the lubrication between the orbiting scroll component and the thrust surface of the thrust plate becomes worse and wear is aggravated, and impurities carbonized at high temperature may fall into the lubricating oil pool, which further reduces the lubricating effect.

Figure 2:
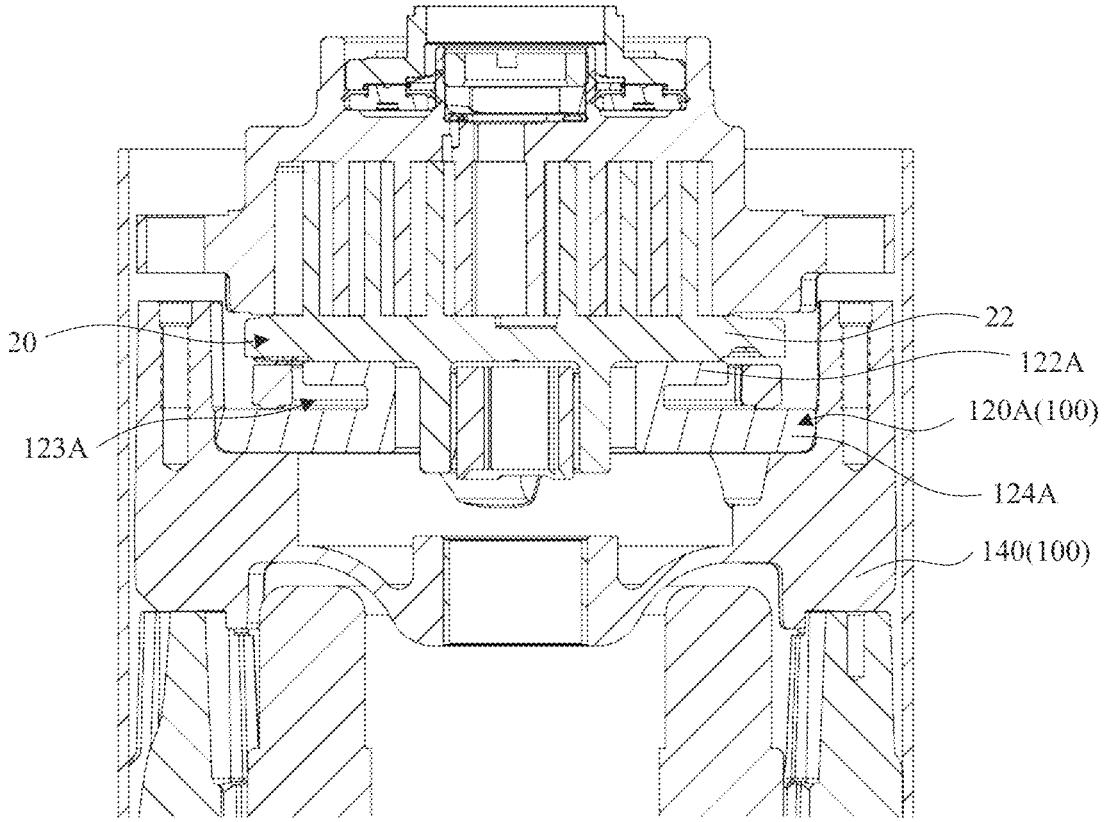
FIG. 2 is a partial cross-sectional view of a scroll compressor including the main bearing seat according to a first embodiment of the disclosure.
Figure 3A:
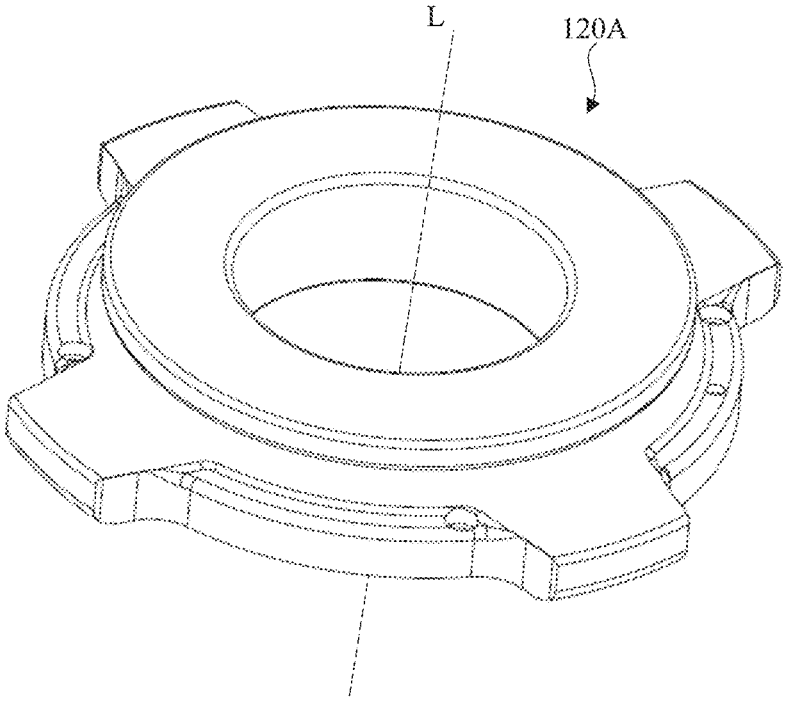
FIG. 3A and FIG. 3B are respectively a perspective view and a cross-sectional view of the thrust portion of the main bearing seat of FIG. 2.
Figure 3B:
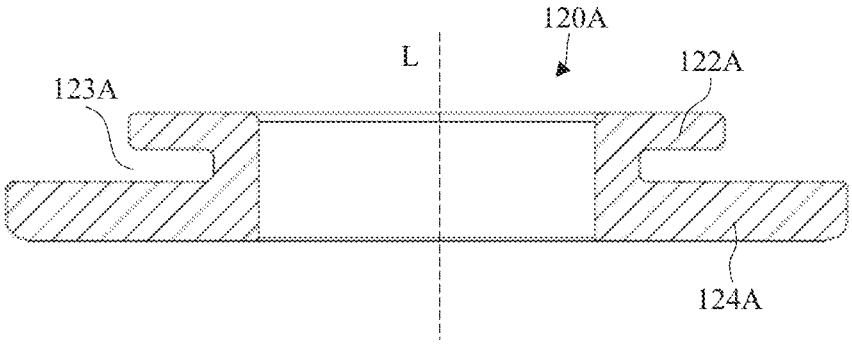

Hereinafter, the main bearing seat 100 according to the first embodiment of the disclosure is described with reference to FIG. 2 to FIG. 3B.

In this embodiment, the main bearing seat 100 includes a substantially annular thrust portion 120A for supporting the orbiting scroll component 20 and a main body portion 140 provided with a bearing to support the drive shaft. The thrust portion 120A is provided with an outer groove 123A in the radially outer portion to form an upper suspension portion 122A and a lower suspension portion 124A extending in the radial direction of the scroll compressor. The upper suspension portion 122A and the lower suspension portion 124A are arranged along the axial direction L of the scroll compressor. The radially outer end of the lower suspension portion 124A is fixed to the main body portion 140. That is, the radially inner end of the lower suspension portion 124A is suspended. In other aspects of the embodiment, the radially outer end of the lower suspension portion 124A may be integrally formed with the main body portion 140. The upper suspension portion 122A of the thrust portion 120A is provided with a thrust surface that axially supports the orbiting scroll end plate 22 of the orbiting scroll 20, so as to axially support the orbiting of the orbiting scroll component 20. Regarding the lower suspension portion, the radially outer end of the lower suspension portion is formed as a relatively rigid end because it is fixed to the main body, and the radially inner end of the lower suspension portion is a relatively flexible end. Regarding the upper suspension portion, the radially outer end of the upper suspension portion is a free end and is formed as a relatively flexible end, and the radially inner end of the upper suspension portion is a relatively rigid end. That is, for each suspension portion, one end is a relatively rigid end, and the other end is a relatively flexible end.

By virtue of the structure of multiple suspension portions arranged in the axial direction of the thrust portion, and in particular, by virtue of the structure that the upper and lower suspension portions have opposite rigid ends and flexible ends located on the radially inner side and the radially outer side, and the positions of the rigid ends and flexible ends of adjacent suspension portions are opposite, the overall rigidity of the thrust portion is adjusted to better achieve the rigidity matching and deformation coordination with the bottom surface of the orbiting scroll. Therefore, for example, the effective contact area is increased at the contact side of the thrust surface to obtain more uniform contact stress distribution to reduce wear, and without affecting the original oil supply structure, a suitable gap is provided on the non-contact side of the thrust surface for the circulation of lubricating oil to facilitate the lubrication of the thrust surface. In addition, the groove forming the suspending portion not only facilitates the cooling of the thrust portion itself, but also allows refrigerant to enter and further promote cooling of the thrust surface.

As can be understood by those skilled in the art, the present application aims to provide multiple suspension portions with opposite rigid portions and flexible portions for the thrust structure so as to adjust the rigidity of the thrust structure and achieve good rigidity matching and deformation coordination. Therefore, in addition to forming the suspension portion in the groove, it is not excluded that the suspension portion is formed by other means, for example, the suspension portion is provided in a suspended manner. Additionally or alternatively, the thrust portion may be provided with an inner groove in the radially inner portion to form multiple suspension portions, and the number of grooves or suspension portions may be set according to actual needs.

In one aspect, advantageously, the multiple suspension portions may partially overlap each other when viewed in the axial direction. For example, the overlap of multiple suspension portions can be achieved, by providing multiple inner and outer grooves and overlapping these grooves. However, it is conceivable that the grooves may be completely overlapped or not overlapped.

In the embodiment, the flexible end portion of the upper suspension portion 122A is located on the radially outer side and the rigid end portion of the upper suspension portion 1221A is located on the radially inner side. In addition, the flexible end of the lower suspension portion 124A may be located on the radially inner side and the rigid end of the lower suspension portion 124A is located on the radially outer side. That is, the positions of the rigid end and the flexible end of the upper suspension portion are opposite to the positions of the rigid end and the flexible end of the adjacent lower suspension portion, which further facilitates the adjustment of the overall rigidity of the thrust portion to better achieve the rigidity matching and deformation coordination with the bottom surface of the orbiting scroll. It can be understood that in a case where there are more than two suspension portions and there are multiple pairs of adjacent suspension portions, the positions of the rigid end and flexible end of one suspension portion in at least one pair of adjacent suspension portions are opposite to the positions of rigid end and flexible end of another suspension portion. However, it is also conceivable that each pair of suspension portions in multiple pairs of adjacent suspension portions is set as: the positions of the rigid end and the flexible end of one suspension portion are opposite to the positions of the rigid end and the flexible end of the other suspension portion.

Figure 4:
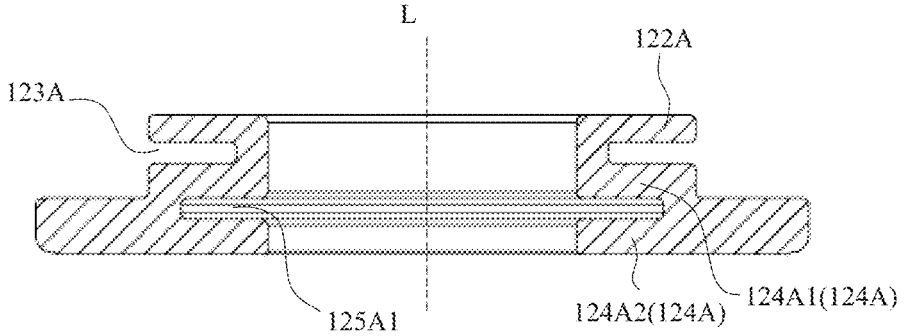
FIG. 4 is a cross-sectional view of the thrust portion of the main bearing seat according to a second embodiment of the disclosure.

Hereinafter, the thrust portion of the main bearing seat according to the second embodiment of the disclosure is described with reference to FIG. 4. In fact, this second embodiment is a modification of the first embodiment and is different from the first embodiment in: a middle additional groove 125A1 is provided in the radially inner portion of the lower suspension portion 124A, so that the lower suspension portion 124A includes a first lower suspension portion 124A1 located in the middle and a second lower suspension portion 124A2 located on the lower side, wherein the middle additional groove 125A1 and the outer groove 123A partially overlap each other. Compared with the first embodiment, a suspension portion is added, where the first lower suspension portion 124A1 has a flexible end located on the radially inner side and an opposite rigid end located on the radially outer side; the second lower suspension portion 124A2 has a flexible end located on the radially inner side and an opposite rigid end located on the radially outer side, which is further conducive to adjusting the overall rigidity in the thrust structure to achieve rigidity matching and deformation coordination between the thrust portion and the bottom surface of the orbiting scroll.

Figure 5A:
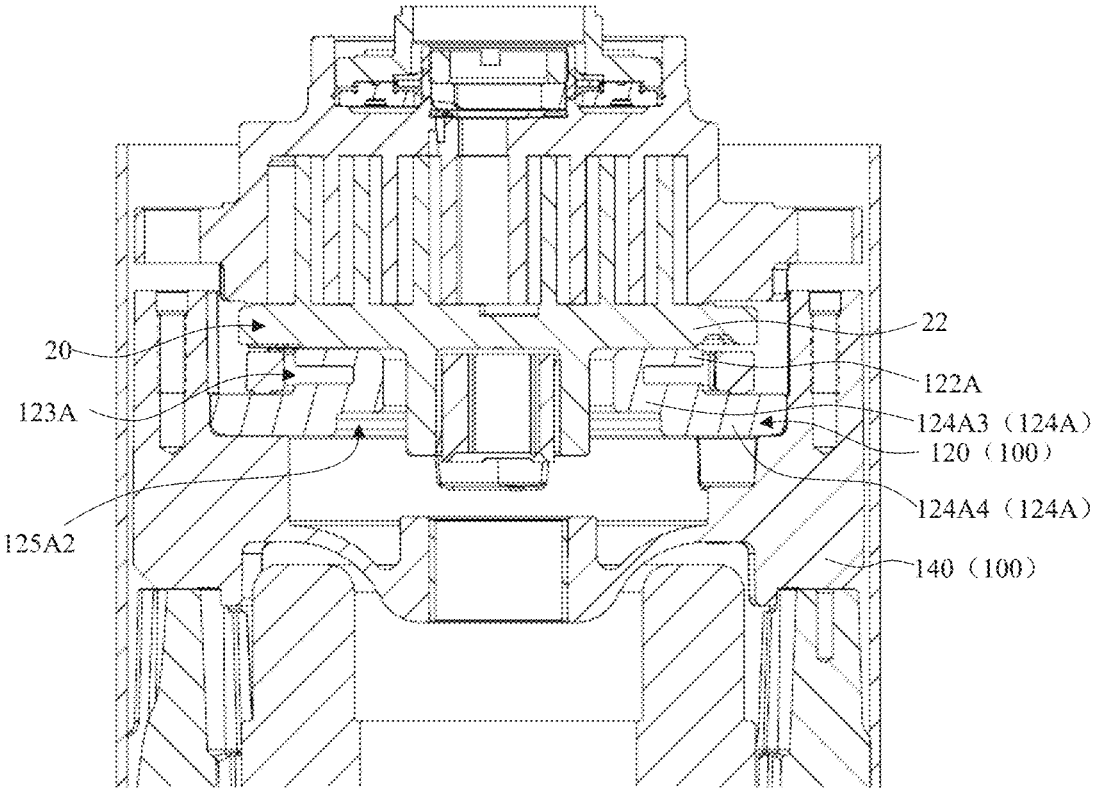
FIG. 5A is a partial cross-sectional view of the scroll compressor of the main bearing seat according to a third embodiment of the disclosure.
Figure 5B:
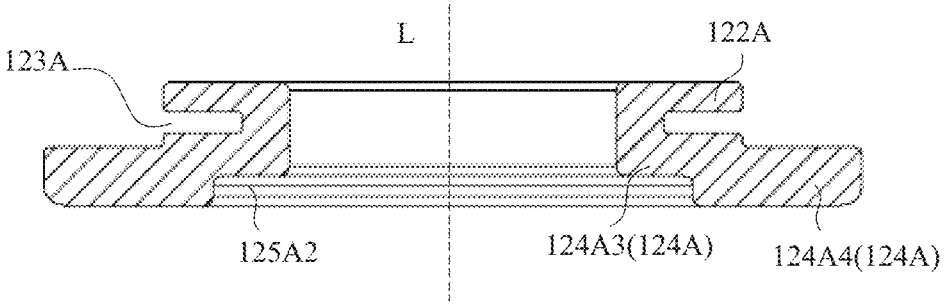
FIG. 5B is a cross-sectional view of the thrust portion of the main bearing seat of FIG. 5A.

The thrust portion of the main bearing seat according to the third embodiment of the disclosure is described with reference to FIG. 5A to FIG. 5B. In addition, this third embodiment is a modification of the first embodiment and is different from the first embodiment in: a lower additional groove 125A2 that also opens downward is provided in the radially inner portion of the lower suspension portion 124A, and thus the lower suspension portion 124A includes an inner suspension portion 124A3 located on the radially inner side and an outer suspension portion 124A4 located on the radially outer side. In the axial direction of the compressor, the inner suspension portion 124A3 is located on the upper side, and the outer suspension portion 124A4 is located on the lower side, and the lower additional groove 125A2 and the outer groove 123A partially overlap each other. Compared with the first embodiment, a suspension portion is added, where the inner suspension portion 124A3 has a flexible end located on the radially inner side and an opposite rigid end located on the radially outer side; the outer suspension portion 124A4 has a flexible end located on the radially inner side and an opposite rigid end located on the radially outer side; which is further conducive to adjusting the overall rigidity in the thrust structure to achieve rigidity matching and deformation coordination between the thrust portion and the bottom surface of the orbiting scroll.

Figure 6:
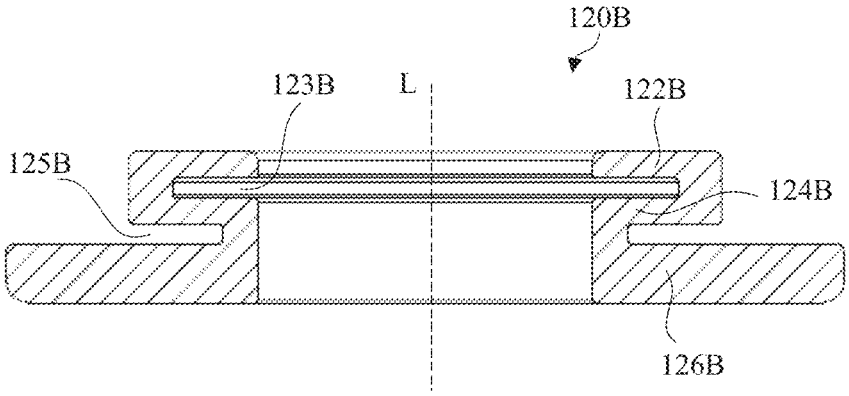
FIG. 6 is a cross-sectional view of the thrust portion of the main bearing seat according to a fourth embodiment of the disclosure.

Further, the thrust portion of the main bearing seat according to the fourth embodiment of the disclosure is described with reference to FIG. 6. In this embodiment, an upper inner groove 123B is provided in the radially inner portion of the thrust portion 120B, and a lower outer groove 125B is provided in the radially outer portion of the thrust portion 120B. The suspension portion includes the upper suspension portion 122B, the middle suspension portion 124B and the lower suspension portion 126B, and a radially outer end of the lower suspension portion 126B is fixed to the main body portion 140. Thereby the flexible end of the upper suspension portion 122B is located on the radially inner side and the rigid end of the upper suspension portion is located on the radially outer side. The flexible end of the middle suspension portion 124B is located on the radially outer side and the opposite rigid end of the middle suspension portion is located on the radially inner side. In addition, the flexible end of the lower suspension portion 126B is located on the radially inner side and the opposite rigid end of the lower suspension portion is located on the radially outer side. With this embodiment, since three suspension portions are provided, and for each pair of suspension portions in two pairs of adjacent suspension portions, the positions of the rigid end and the flexible end of one suspension portion are opposite to the positions of the rigid end and the flexible end of the other suspension portion, which may more effectively and comprehensively adjust the overall rigidity of the thrust portion, so as to better achieve the rigidity matching and deformation coordination with the bottom surface of the orbiting scroll.

Figure 7:
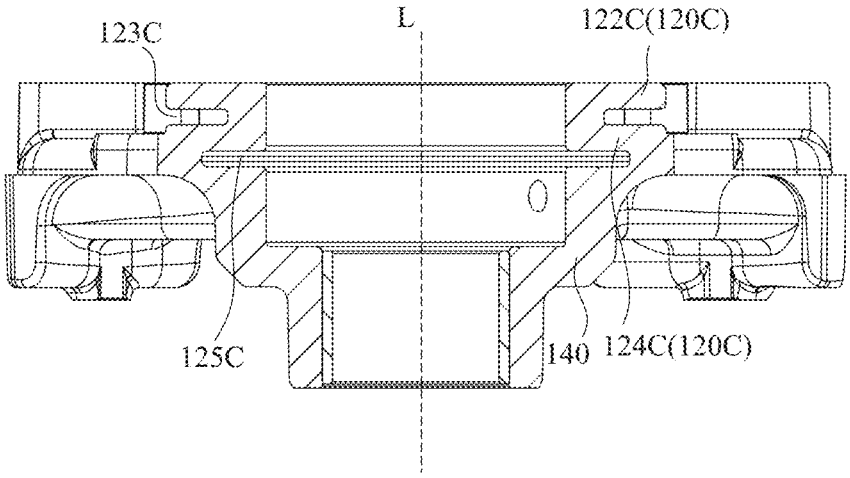
FIG. 7 is a cross-sectional view of a main bearing seat according to a fifth embodiment of the disclosure, in which a thrust portion and a main body portion of the main bearing seat are integrally formed.

Hereinafter, the thrust portion of the main bearing seat according to the fourth embodiment of the disclosure is described with reference to FIG. 7. In this embodiment, the thrust portion 120C and the main body portion 140 are integrally formed, an upper outer groove 123C is provided in the radially outer portion of the thrust portion 120C, and a lower inner groove 125C is provided in the radially inner portion of the thrust portion 120C, thereby forming an upper suspension portion 122C and a lower suspension portion 124C, thereby the flexible end of the upper suspension portion 122C; is located on the radially outer side and the opposite rigid end of the upper suspension portion is located on the radially inner side, and the flexible end of the lower suspension portion 124C; is located on the radially inner side and the opposite rigid end of the lower suspension portion is located on the radially outer side.

Figure 8A:
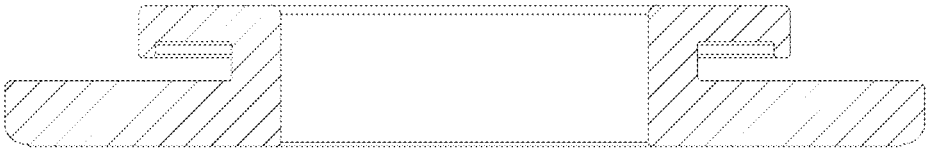
FIG. 8A to FIG. 8D are a series of schematic diagrams showing various forms of grooves forming the suspension portion of the thrust portion of the main bearing seat according to the disclosure.
Figure 8B:
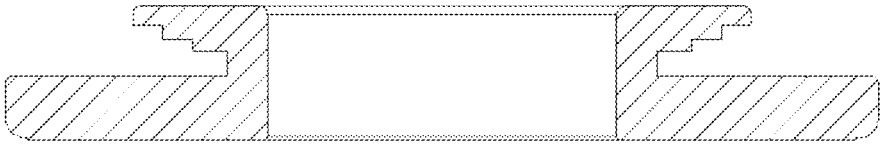
Figure 8C:
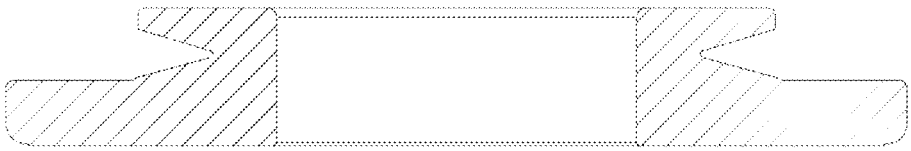
Figure 8D:
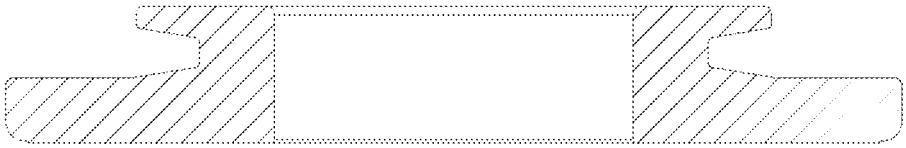

In addition, those skilled in the art can understand that the groove forming the suspension portion of the thrust portion of the above-mentioned embodiment (especially, the first embodiment) may have various shapes, referring to FIG. 8A to FIG. 8B, the upper wall of the groove closest to the thrust surface of the thrust portion is provided with a stepped portion or a recessed portion. Referring to FIG. 8C to FIG. 8D, the groove is configured to be rectangular, U-shaped, V-shaped or a trapezoid with a narrow bottom opening and a wide opening in a cross section along the axial direction.

Although various embodiments of the disclosure have been described herein in detail, it should be understood that the disclosure is not limited to the specific embodiments described and illustrated herein in detail, and other variations and modifications can be implemented by the person skilled in the art without departing from the essence and scope of the disclosure. All these modifications and variations fall within the scope of the disclosure. Moreover, all the members described herein can be replaced by other technically equivalent members.

The invention claimed is:

1. A main bearing seat for a scroll compressor, comprising a thrust portion having a substantially annular shape for supporting a compression mechanism of the scroll compressor and a main body portion provided with a bearing to support a drive shaft of the scroll compressor, wherein a plurality of suspension portions extending in a radial direction of the scroll compressor are provided in the thrust portion, and the plurality of suspension portions are arranged along an axial direction of the scroll compressor so that when viewed in the axial direction, the plurality of suspension portions partially or completely overlap each other, wherein each of the plurality of suspension portions has opposite rigid end and flexible end on both sides in the radial direction, in the plurality of suspension portions, at least one pair of adjacent suspension portions partially or completely overlapping each other in the axial direction comprises a first suspension portion and a second suspension portion, positions in the radial direction of a rigid end and a flexible end of the first suspension portion are opposite to positions in the radial direction of a rigid end and a flexible end of the second suspension portion.

2. The main bearing seat according to claim 1, wherein one or more grooves are provided in a radially inner portion and/or a radially outer portion of the thrust portion, thereby forming the suspension portion.

3. The main bearing seat according to claim 2, wherein the groove comprises an outer groove provided in the radially outer portion of the thrust portion, and thus the suspension portion comprises an upper suspension portion and a lower suspension portion, a radially outer end of the lower suspension portion is fixed to the main body portion, thereby a flexible end of the upper suspension portion is located on the radially outer side and a rigid end of the upper suspension portion is located on the radially inner side, and a flexible end of the lower suspension portion is located on the radially inner side and a rigid end of the lower suspension portion is located on the radially outer side.

4. The main bearing seat according to claim 3, wherein the groove further comprises a middle additional groove provided in a radially inner portion of the lower suspension portion, and thus the lower suspension portion comprises a first lower suspension portion located in the middle and a second lower suspension portion located on the lower side.

5. The main bearing seat according to claim 3, wherein the groove further comprises a lower additional groove opened downward provided in a radially inner portion of the lower suspension portion, and thus the lower suspension portion comprises an inner suspension portion located on the radially inner side and an outer suspension portion located on the radially outer side.

6. The main bearing seat according to claim 2, wherein the groove comprises an upper inner groove provided in the radially inner portion of the thrust portion and a lower outer groove provided in the radially outer portion of the thrust portion, and thus the suspension portion comprises a upper suspension portion, a middle suspension portion and a lower suspension portion, and a radially outer end of the lower suspension portion is fixed to the main body portion, thereby a flexible end of the upper suspension portion is located on the radially inner side and a rigid end of the upper suspension portion is located on the radially outer side, a flexible end of the middle suspension portion is located on the radially outer side and a rigid end of the middle suspension portion is located on the radially inner side, and a flexible end of the lower suspension portion is located on the radially inner side and a rigid end of the lower suspension portion is located on the radially outer side.

7. The main bearing seat according to claim 2, wherein the thrust portion and the main body portion are integrally formed.

8. The main bearing seat according to claim 7, wherein the groove comprises an upper outer groove provided in the radially outer portion of the thrust portion and a lower inner groove provided in the radially inner portion of the thrust portion, and thus the suspension portion comprises an upper suspension portion and a lower suspension portion, thereby a flexible end of the upper suspension portion is located on the radially outer side and a rigid end of the upper suspension portion is located on the radially inner side, and a flexible end of the lower suspension portion is located on the radially inner side and a rigid end of the lower suspension portion is located on the radially outer side.

9. The main bearing seat according to claim 2, wherein the groove is configured to be rectangular, U-shaped, V-shaped or a trapezoid with a narrow bottom and a wide opening in a section along the axial direction.

10. The main bearing seat according to claim 2, wherein an upper wall of the groove closest to a thrust surface of the thrust portion is provided with a stepped portion or a recessed portion.

11. A scroll compressor, wherein the scroll compressor comprise the main bearing seat according to claim 1.

12. The scroll compressor according to claim 11, wherein the compression mechanism comprises an orbiting scroll having an orbiting scroll end plate, the thrust portion is provided with a thrust surface that axially supports the orbiting scroll end plate, thereby axially supporting the orbiting of the orbiting scroll.

* * * * *